US011124720B2

(12) United States Patent
Bartley et al.

(10) Patent No.: US 11,124,720 B2
(45) Date of Patent: Sep. 21, 2021

(54) FUEL ADDITIVES

(71) Applicant: The Lubrizol Corporation, Wickliffe, OH (US)

(72) Inventors: Stuart L. Bartley, Wickliffe, OH (US); Paul R. Stevenson, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/489,855

(22) PCT Filed: Mar. 5, 2018

(86) PCT No.: PCT/US2018/020834

§ 371 (c)(1),
(2) Date: Aug. 29, 2019

(87) PCT Pub. No.: WO2018/164979

PCT Pub. Date: Sep. 13, 2018

(65) Prior Publication Data

US 2019/0382673 A1 Dec. 19, 2019

Related U.S. Application Data

(60) Provisional application No. 62/467,292, filed on Mar. 6, 2017.

(51) Int. Cl.
*C10L 1/188* (2006.01)
*C10L 1/19* (2006.01)
(Continued)

(52) U.S. Cl.
CPC ..... *C10L 1/1883* (2013.01); *C10L 1/1905* (2013.01); *C10L 10/06* (2013.01); *C10L 10/08* (2013.01);
(Continued)

(58) Field of Classification Search
CPC ..... C10L 1/1883; C10L 1/1905; C10L 10/06; C10L 10/08; C10L 1/1608; C10L 1/1616;
(Continued)

(56) References Cited

U.S. PATENT DOCUMENTS 2,647,872 A * 8/1953 Peterson ..... C10M 5/00 508/144
2014/0290612 A1* 10/2014 Guinther ..... F02M 25/00 123/1 A
2017/0096610 A1* 4/2017 Bush ..... C10L 1/232

FOREIGN PATENT DOCUMENTS

CN 104962328 A 10/2015
EA 0084910 A2 8/1983
(Continued)

OTHER PUBLICATIONS

Jean Michel Martin et al., "Mechanism of Friction Reduction of Unsaturated Fatty Acids as Additives in Diesel Fuels", vol. 1, No. 3, Sep. 1, 2013, pp. 257-258.

*Primary Examiner* — Ellen M McAvoy
*Assistant Examiner* — Chantel L Graham
(74) *Attorney, Agent, or Firm* — Iken S. Sans; Teresan W. Gilbert

(57) ABSTRACT

Additive compositions comprising (a) a hydroxycarboxylic acid; and (b) a compound derived from a hydrocarbyl-substituted succinic acid or anhydride wherein the ratio of (a) to (b) in the additive composition ranges from 1:9 to 9:1. The additive compositions may be added to a fuel. Methods of reducing wear in an engine comprising operating the engine using a fuel composition have the additive composition therein. The use of an additive composition in a fuel composition to reduce the fuel composition's coefficient of friction or to reduce wear in an engine.

13 Claims, 1 Drawing Sheet

(51) Int. Cl.

| | |
|---|---|
| ***C10L 10/06*** | (2006.01) |
| ***C10L 10/08*** | (2006.01) |
| *C10L 1/16* | (2006.01) |
| *C10L 1/182* | (2006.01) |
| *C10L 1/2387* | (2006.01) |

(52) U.S. Cl.
CPC ..... *C10L 1/1608* (2013.01); *C10L 1/1616* (2013.01); *C10L 1/1824* (2013.01); *C10L 1/191* (2013.01); *C10L 1/2387* (2013.01); *C10L 2200/0423* (2013.01); *C10L 2270/023* (2013.01)

(58) Field of Classification Search
CPC ..... C10L 1/1824; C10L 1/1881; C10L 1/191; C10L 1/2387; C10L 2200/0423; C10L 2270/023
See application file for complete search history.

(56) References Cited

FOREIGN PATENT DOCUMENTS

| | | | | |
|---|---|---|---|---|
| WO | 2012/162219 | A1 | 11/2012 | |
| WO | WO-2012162219 | A1 * | 11/2012 | ..... C10M 133/02 |
| WO | 2016/184897 | A1 | 11/2016 | |

* cited by examiner

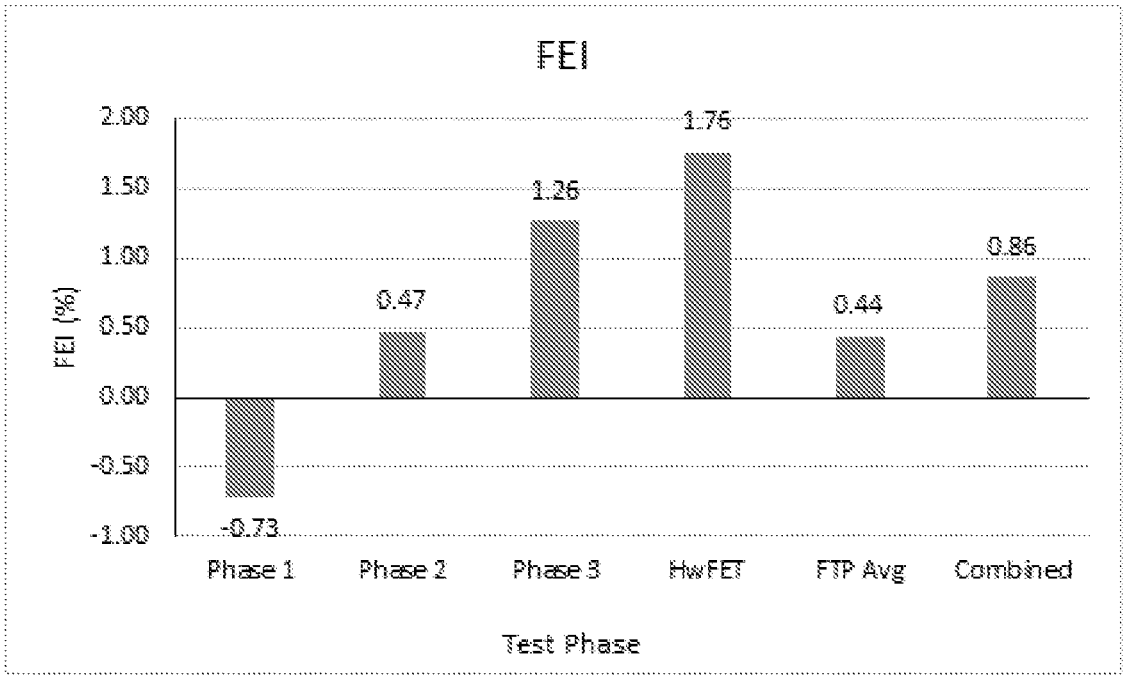
FEI
2.00
1.50
1.00
0.50
0.00
-0.50
-1.00
FEI (%)
-0.73
0.47
1.26
1.76
0.44
0.86
Phase 1
Phase 2
Phase 3
HwFET
FTP Avg
Combined
Test Phase

FUEL ADDITIVES

CROSS REFERENCE TO RELATED APPLICATION

This application claims priority from PCT Application Serial No. PCT/US2018/020834 filed on Mar. 5, 2018, which claims the benefit of U.S. Provisional Application No. 62/467,292 filed on Mar. 6, 2017, both of which are incorporated in their entirety by reference herein.

FIELD OF THE INVENTION

The field of the disclosed technology is generally related to fuel additives comprising hydroxycarboxylic acid and compounds derived from a hydrocarbyl-substituted succinic acid or anhydride.

BACKGROUND OF THE INVENTION

As much as 25% of an automobile's fuel consumption can be the result of friction between moving metal parts in the engine. Most of the friction occurs between the surfaces of the engine pistons and cylinders. Friction modifiers are added to fuels to reduce this friction. As the fuel is drawn into the combustion chambers through the fuel intake valves, the friction modifiers coat the cylinder surfaces creating a sacrificial layer that lubricates and protects them from excessive wear as the pistons move up and down. Small quantities of friction modifiers can also move through the bottom of the cylinders into the crankcase and lubricate the crankcase as well. By lubricating engine components and reducing friction, friction modifiers can in turn improve fuel economy which in turn can even reduce vehicle emissions.

Friction modifiers are often sold to fuel producers mixed with other desirable fuel additives. This mixture of fuel additives can be called additive packs or packages. While friction modifiers are generally soluble in fuels, they can have solubility issues in in concentrated additive packages, particularly when stored for long periods of time or stored at low temperatures. To improve solubility of friction modifiers in additive packages, high quantities of solvents, such as 2-ethylhexanol, are added. The solvents increase not only the cost of the additive packages themselves, but increase transportation costs as well.

SUMMARY OF THE INVENTION

A new composition comprising a hydroxycarboxylic acid and a compound derived from a hydrocarbyl-substituted succinic acid or anhydride ("HSSA compound") was surprisingly found to have improved additive pack stability, friction and wear performance. Accordingly, an additive composition is disclosed herein. The composition may comprise (a) a hydroxycarboxylic acid and (b) a compound derived from a hydrocarbyl-substituted succinic acid or anhydride ("HSSA compound") wherein the ratio of (a) to (b) ranges from 1:9 to 9:1, 1:8 to 8:1, 1:7 to 7:1, 1:6 to 6:1, 1:5 to 5:1, 1:4 to 4:1, or 1:3 to 3:1. The additive composition may be used in a fuel as a friction modifier. The additive composition may also function as a corrosion inhibitor when added to a fuel.

In another embodiment, the additive composition may further comprise (c) an organic solvent. The organic solvent may comprise at least one of 2-ethylhexanol, naphtha, dimethylbenzene, or mixtures thereof.

At least a portion of the HSSA compound may have the formula (I):

(I)

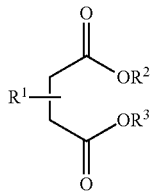

wherein $R^1$ is hydrogen or a $C_1$ to $C_{50}$ linear or branched hydrocarbyl group; and at least one of $R^2$ and $R^3$ is present and is a hydrocarbyl amine group or a $C_1$ to $C_5$ hydrocarbyl group, and the other of $R^2$ and $R^3$, if present, is a hydrogen or a $C_1$ to $C_5$ hydrocarbyl group. In one embodiment, at least one of $R^2$ and $R^3$ comprises at least one hetero atom. In other embodiments, the hetero atom is nitrogen. In yet other embodiments, the hetero atom is oxygen.

In another embodiment, at least a portion of the HSSA compound may have the formula (II):

(II)

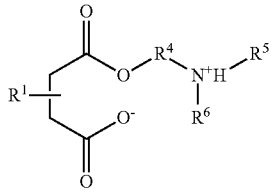

wherein $R^1$ is hydrogen or a $C_1$ to $C_{50}$ linear or branched hydrocarbyl group; $R^4$ is a $C_1$ to $C_5$ linear or branched hydrocarbyl group; and $R^5$ and $R^6$ are independently hydrogen or a $C_1$ to $C_4$ linear or branched hydrocarbyl group. In one embodiment, $R^1$ is a $C_{16}$ hydrocarbyl group; $R^4$ is a $C_2$ hydrocarbyl group; and both $R^5$ and $R^6$ are methyl groups.

In yet another embodiment, at least a portion of the HSSA compound may have the formula (III):

(III)

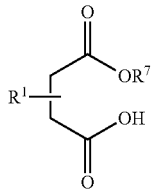

wherein $R^1$ is hydrogen or a $C_1$ to $C_{50}$ linear or branched hydrocarbyl group; and $R^7$ is a $C_1$ to $C_5$ hydrocarbyl group. In yet another embodiment, $R^7$ has at least one hydroxyl group. In another embodiment, $R^7$ is a $C_3$ hydrocarbyl group with one hydroxyl group in the beta position.

In yet other embodiments, the HSSA compound may have the formulas above, wherein $R^1$ may be a linear or branched $C_8$ to $C_{25}$ hydrocarbyl group. Exemplary hydrocarbyl groups include, but are not limited to, $C_8$ to $C_{18}$, $C_{10}$ to $C_{16}$, or $C_{13}$ to $C_{17}$, linear or branched hydrocarbyl groups. In one embodiment, $R^1$ may be a linear or branched $C_{12}$ to $C_{16}$ hydrocarbyl group. In one embodiment, $R^1$ may be dodecyl or hexadecyl group. In yet another embodiment, $R^1$ may be a branched dodecyl or linear or branched hexadecyl group.

At least a portion of the hydroxycarboxylic acid may have the formula (IV):

(IV)

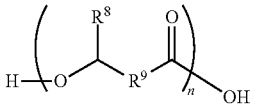

wherein $R^8$ is hydrogen or a $C_1$ to $C_{20}$ hydrocarbyl group; $R^9$ is a $C_1$ to $C_{20}$ hydrocarbyl group; and n is a number from 1 to 8. Accordingly, the hydroxycarboxylic acid may be a monohydroxycarboxylic acid or polyhydroxycarboxylic acid. In one embodiment, $R^8$ and $R^9$ may independently have saturated or unsaturated hydrocarbyl groups. In one embodiment, the hydrocarbyl groups of both $R^8$ and $R^9$ are all unsaturated. In yet another embodiment, at least one of $R^8$ and $R^9$ has at least one saturated hydrocarbyl group. In other embodiments, the hydroxycarboxylic acid may comprise at least one of 12-hydroxystearic acid, ricinoleic acid, or mixtures thereof.

Fuel compositions comprising the additive compositions described above are also disclosed. In one embodiment, the fuel composition may be a fuel composition comprising (i) fuel and (ii) an additive composition as described above. The additive composition may be present in an amount of at least 0.1 ppm to 1000 ppm based on a total weight of the fuel composition. The fuel composition may comprise gasoline, an oxygenate such as ethanol, or mixtures thereof. In one embodiment, the fuel composition may comprise 0.1 vol % to 100 vol % oxygenate, based on a total volume of the fuel composition. In another embodiment, the fuel composition may comprise 0.1 vol % to 100 vol % gasoline, based on a total volume of the fuel composition. In yet another embodiment, the fuel composition may comprise, (i) gasoline, (ii) ethanol, and (iii) the additive composition as described above.

Methods of reducing wear in, and/or increasing the Fuel Economy Index ("FEI") of, an engine are also disclosed. The method may comprise operating the engine on the fuel composition described above. The FEI may be increased by at least 0.8% or even 1%.

The use of an additive composition as described above in a fuel composition to reduce the fuel composition's coefficient of friction and/or reduce wear in, and/or increase the FEI of, an engine is also disclosed. The additive composition may be present in the fuel composition in an amount of 10 ppm to 1000 ppm, based on a total weight of the fuel composition. The additive composition may be used in gasoline, an oxygenate, or mixtures thereof. In an alternative embodiment, the additive composition may be used in a fuel comprising 0.1 vol % to 100 vol % oxygenate, based on a total volume of the fuel composition. Engines suitable for the methods or uses above include gasoline direct injection ("GDr") engines, port fuel injection ("PFr") engines, or combination thereof.

BRIEF DESCRIPTION OF THE FIGURES

FIG. 1 is a graph showing the Fuel Economy Index ("FEI") of an exemplary friciton modifier package (FM Ex 7 comprising 12-hydroxystearic acid:HSSA Formula II:HAN at 15:35:50).

DETAILED DESCRIPTION OF THE INVENTION

Various features and embodiments will be described below by way of nonlimiting illustration. An additive composition is disclosed herein. The composition may comprise (a) a hydroxycarboxylic acid and (b) a compound derived from a hydrocarbyl-substituted succinic acid or anhydride ("HSSA compound") wherein the ratio of (a) to (b) ranges from 1:9 to 9:1, 1:8 to 8:1, 1:7 to 7:1, 1:6 to 6:1, 1:5 to 5:1, 1:4 to 4:1, or 1:3 to 3:1. The additive composition may be used in a fuel as a friction modifier. The additive composition was surprisingly found to have a synergistic effect in improving additive pack stability, and when added to a fuel, friction and wear performance.

In some embodiments, the ratio of (a) a hydroxycarboxylic acid to (b) a HSSA compound in the additive composition may be any ratio ranging from 1:3 to 3:1. In some embodiments, the ratio of (a) to (b), i.e. (a):(b), may be 1:1, 1:2, 1:3, 3:1, or 2:1. In other embodiments, the ratio of (a) to (b) may range from 2:1 to 3:1. In yet another embodiment, (a):(b) may be about 1:2.3.

At least a portion of the HSSA compound may have the formula (I):

(I)

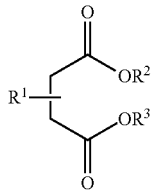

wherein $R^1$ is hydrogen or a $C_1$ to $C_{50}$ linear or branched hydrocarbyl group; and at least one of $R^2$ and $R^3$ is present and is a hydrocarbyl amine group or a $C_1$ to $C_5$ hydrocarbyl group, and the other of $R^2$ and $R^3$, if present, is a hydrogen or a $C_1$ to $C_5$ hydrocarbyl group. In one embodiment, at least one of $R^2$ and $R^3$ comprises at least one hetero atom. In other embodiments, the hetero atom is nitrogen. In yet other embodiments, the hetero atom is oxygen.

The hydroxyamine may be a primary, secondary or tertiary amine. Typically, the hydroxamines are primary, secondary or tertiary alkanol amines. The alkanol amines may be represented by the formulae:

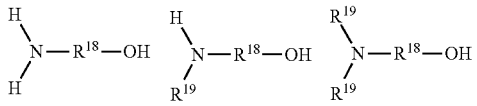

wherein in the above formulae each $R^{18}$ independently is a hydrocarbylene (i.e., a divalent hydrocarbon) group of 2 to about 18 carbon atoms and each $R^{19}$ is independently a hydrocarbyl group of 1 to about 8 carbon atoms, or a hydroxy-substituted hydrocarbyl group of 2 to about 8 carbon atoms. The group —$R^{18}$—OH in such formulae represents the hydroxy-substituted hydrocarbylene group. $R^{18}$ may be an acyclic, alicyclic, or aromatic group. In one embodiment, $R^{18}$ is an acyclic straight or branched alkylene group such as ethylene, 1,2-propylene, 1,2-butylene, 1,2-octadecylene, etc. group. When two $R^{19}$ groups are present in the same molecule they may be joined by a direct carbon-to-carbon bond or through a heteroatom (e.g., oxygen or nitrogen) to form a 5-, 6-, 7- or 8-membered ring structure. Examples of such heterocyclic amines include N-(hydroxy lower alkyl)-morpholines, -piperidines, -oxazolidines, and the like. Typically, however, each $R^{19}$ is independently a lower alkyl group of up to seven carbon atoms.

Suitable examples of the above hydroxyamines include mono-, di-; and triethanolamine, dimethylethanol amine, diethylethanol amine, di-(3-hydroxypropyl) amine, N-(3-hydroxybutyl) amine, N-(4-hydroxybutyl) amine, and N,N-di-(2-hydroxypropyl) amine.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context disclosed herein, do not alter the predominantly hydrocarbon nature of the substituent (e.g. hydroxy, alkoxy, nitro, and nitroso);

hetero substituents, that is, substituents which, while having a predominantly hydrocarbon character, in the context disclosed herein, contain other than carbon in a ring or chain otherwise composed of carbon atoms and encompass substituents as pyridyl, furyl, and imidazolyl. Heteroatoms include oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

In another embodiment, at least a portion of the HSSA compound may have the formula (II):

(II)

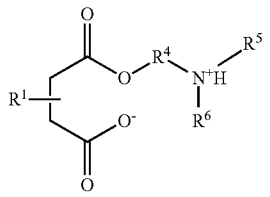

wherein $R^1$ is hydrogen or a $C_1$ to $C_{50}$ linear or branched hydrocarbyl group; $R^4$ is a $C_1$ to $C_5$ linear or branched hydrocarbyl group; and $R^5$ and $R^6$ are independently hydrogen or a $C_1$ to $C_4$ linear or branched hydrocarbyl group. In one embodiment, $R^1$ is a $C_{16}$ hydrocarbyl group; $R^4$ is a $C_2$ hydrocarbyl group; and both $R^5$ and $R^6$ are methyl groups.

In another embodiment, at least a portion of the HSSA compound may have the formula (V):

(V)

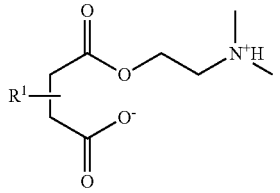

wherein $R^1$ is hydrogen or a $C_1$ to $C_{50}$ linear or branched hydrocarbyl group. In one embodiment, $R^1$ is a $C_{12}$ to $C_{20}$ linear or branched hydrocarbyl group. In yet another embodiment, $R^1$ is a $C_{16}$ linear hydrocarbyl group. It yet other embodiments, the HSSA compound may comprise a hexadecenyl succinic anhydride product with N,N-dimethylethanolamine.

In yet another embodiment, at least a portion of the HSSA compound may have the formula (III):

(III)

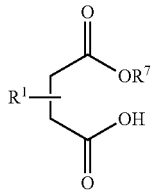

wherein $R^1$ is hydrogen or a $C_1$ to $C_{50}$ linear or branched hydrocarbyl group; and $R^7$ is a linear or branched $C_1$ to $C_5$ hydrocarbyl group. In yet another embodiment, $R^7$ has at least one hydroxyl group. In another embodiment, $R^7$ is a $C_3$ hydrocarbyl group with one hydroxyl group in the beta position.

In another embodiment, at least a portion of the HSSA compound may have the formula (VI):

(VI)

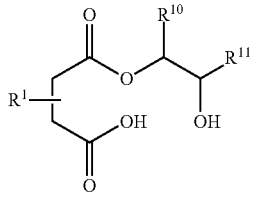

wherein $R^1$ is hydrogen or a $C_1$ to $C_{50}$ linear or branched hydrocarbyl group; and $R^0$ is hydrogen or a linear or branched $C_1$ to $C_5$ hydrocarbyl group; and $R^{11}$ is hydrogen or a linear or branched $C_1$ to $C_5$ hydrocarbyl group. In one embodiment, $R^1$ is a $C_{12}$ to $C_{20}$ linear or branched hydrocarbyl group. In yet another embodiment, $R^1$ is a $C_{12}$ linear hydrocarbyl group, and at least one of $R^{10}$ and $R^{11}$ is a methyl group.

In yet other embodiments, the HSSA compound may have the formulas above, wherein $R^1$ may be a linear or branched $C_8$ to $C_{25}$ hydrocarbyl group. Exemplary hydrocarbyl groups include, but are not limited to, $C_8$ to $C_{18}$, $C_{10}$ to $C_{16}$, or $C_{13}$ to $C_{17}$, linear or branched hydrocarbyl groups. In one embodiment, $R^1$ may be a linear or branched $C_{12}$ to $C_{16}$ hydrocarbyl group. In one embodiment, $R^1$ may be dodecyl or hexadecyl group. In yet another embodiment, $R^1$ may be a linear dodecyl or linear hexadecyl group.

In yet other embodiments, $R^1$ may be a polyisobutylene ("PIB") group having a number average molecular weight ("$M_n$") of 250 to 650, or 350 to 550. As used herein, the number average molecular weight ($M_n$) is measured using gel permeation chromatography ("GPC") (Waters GPC 2000) based on polystyrene standards. The instrument is equipped with a refractive index detector and Waters Empower™ data acquisition and analysis software. The columns are polystyrene (PLgel, 5 micron, available from Agilent/Polymer Laboratories, Inc.). For the mobile phase, individual samples are dissolved in tetrahydrofuran and filtered with PTFE filters before they are injected into the GPC port.

Waters GPC 2000 Operating Conditions:

Injector, Column, and Pump/Solvent compartment temperatures: 40° C.

Autosampler Control: Run time: 40 minutes

Injection volume: 300 microliter

Pump: System pressure: ~90 bars (Max. pressure limit: 270 bars, Min. pressure limit: 0 psi)

Flow rate: 1.0 ml/minute

Differential Refractometer (RI): Sensitivity: −16; Scale factor: 6

At least a portion of the hydroxycarboxylic acid may have the formula (IV):

(IV)

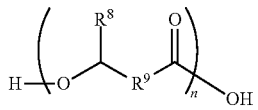

wherein $R^8$ is hydrogen or a $C_1$ to $C_{20}$ hydrocarbyl group; $R^9$ is a $C_1$ to $C_{20}$ hydrocarbyl group; and n is a number from 1 to 8. Accordingly, the hydroxycarboxylic acid may be a monohydroxycarboxylic acid or polyhydroxycarboxylic acid. In one embodiment, $R^8$ and $R^9$ may independently have saturated or unsaturated hydrocarbyl groups. In one embodiment, the hydrocarbyl groups of both $R^8$ and $R^9$ are all unsaturated. In yet another embodiment, at least one of $R^8$ and $R^9$ has at least one saturated hydrocarbyl group. In other embodiments, the hydroxycarboxylic acid may comprise at least one of 12-hydroxystearic acid, ricinoleic acid, or mixtures thereof.

Organic Solvent

In another embodiment, the additive composition may further comprise (c) an organic solvent. The organic solvent may provide for a homogeneous and liquid fuel additive composition that facilitates handling. The organic solvent also provides for a homogeneous fuel composition comprising gasoline and the additive composition.

In some embodiments, the organic solvent may be an aliphatic or aromatic hydrocarbon. These types of organic solvents generally boil in the range of about 65° C. to 235° C. Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Additional organic solvents include aromatic hydrocarbons and mixtures of alcohols with aromatic hydrocarbons or kerosene having enough aromatic content that allows the additive composition to be a fluid at a temperature from about 0° C. to minus 18° C. The aliphatic or aromatic hydrocarbon may be present at about 0 to 70 wt %, 0 to 50 wt %, 0 to 40 wt %, 0 to 35 wt %, or 0 to 30 wt %, based on a total weight of the additive composition.

In some embodiments, the organic solvent may be an alcohol. Alcohols can be aliphatic alcohols having about 2 to 16 or 2 to 10 carbon atoms. In one embodiment, the alcohol can be ethanol, 1-propanol, isopropyl alcohol, 1-butanol, isobutyl alcohol, amyl alcohol, isoamyl alcohol, 2-methyl-1-butanol, and 2-ethylhexanol. The alcohol can be present in the additive composition at about 0 to 40 wt %, 0 to 30 wt %, or 0 to 20 wt %, based on total weight of the additive composition.

In yet another embodiment, the organic solvent may comprise at least one of 2-ethylhexanol, naphtha, dimethylbenzene ("xylene"), or mixtures thereof. Naphtha can include heavy aromatic naphtha ("HAN"). In yet another embodiment, the organic solvent may comprise at least one of 2-ethylhexanol, naphtha, or mixtures thereof.

Fuel

Fuel compositions comprising the additive compositions described above are also disclosed. The fuel composition can comprise the fuel additive concentrate, as described above, and a fuel which is liquid at room temperature and is useful in fueling an engine. The fuel is normally a liquid at ambient conditions e.g., room temperature (20 to 30° C.). The fuel can be a hydrocarbon fuel, a nonhydrocarbon fuel, or a mixture thereof. The hydrocarbon fuel can be a hydrocarbon prepared by a gas to liquid process to include for example hydrocarbons prepared by a process such as the Fischer-Tropsch process. The hydrocarbon fuel can be a petroleum distillate to include a gasoline as defined by ASTM specification D4814. In one embodiment the fuel is a gasoline, and in other embodiments the fuel is a leaded gasoline or a nonleaded gasoline. The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include, for example, methanol, ethanol, butanol, methyl t-butyl ether, methyl ethyl ketone. In several embodiments, the fuel can have an oxygenate content on a volume basis that is 1 percent by volume, or 10 percent by volume, or 50 percent by volume, or up to 85 percent by volume. In yet other embodiments, the fuel can have an oxygenate content of essentially 100 percent by volume (minus any impurities or contaminates, such as water). Mixtures of hydrocarbon and nonhydrocarbon fuels can include, for example, gasoline and methanol and/or ethanol. The ethanol may be a fuel-grade ethanol according to ASTM D4806. In various embodiments, the liquid fuel can be an emulsion of water in a hydrocarbon fuel, a nonhydrocarbon fuel, or a mixture thereof.

Treat rates of the additive composition comprising hydroxycarboxylic acid and an HSSA compound in the fuel range from 5 to 300 ppm by a total weight of the fuel, or 5 to 200 ppm, or 10 to 150 ppm, or 10 to 75 ppm.

In one embodiment, the fuel composition may be a fuel composition comprising (i) fuel and (ii) an additive composition as described above. The additive composition may be present in an amount of at least 0.1 ppm to 1000 ppm based on a total weight of the fuel composition. The fuel composition may comprise gasoline, an oxygenate, or mixtures thereof. In one embodiment, the fuel composition may comprise 0.1 vol % to 100 vol % oxygenate, based on a total volume of the fuel composition. In another embodiment, the fuel composition may comprise 0.1 vol % to 100 vol % gasoline, based on a total weight of the fuel composition. In some embodiments, the oxygenate may be ethanol. In yet another embodiment, the fuel composition may comprise, (i) gasoline, (ii) ethanol, and (iii) the additive composition as described above.

Methods of reducing wear in, and/or increasing the Fuel Economy Index ("FEI") of, an engine are also disclosed. The method may comprise operating the engine on the fuel composition described above. In some embodiments, the FEI may be reduced by at least 0.8%, and in yet other embodiments, by at least 1%. The use of an additive composition as described above in a fuel composition to reduce a fuel composition's coefficient of friction and/or reduce wear in, and/or increase the FEI of, an engine is also disclosed. The additive composition may be present in the fuel composition in an amount of 10 ppm to 1000 ppm, based on a total weight of the fuel composition. The additive composition may be used in gasoline, an oxygenate, or mixtures thereof. In an alternative embodiment, the additive composition may be used in a fuel comprising 0.1 vol % to 100 vol % oxygenate, based on a total volume of the fuel composition. Engines suitable for the methods or uses above include gasoline direct injection ("GDI") engines, a port fuel injection ("PFI") engines, or combinations thereof.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

Additional Performance Additives

The additive compositions and fuel compositions described above can further comprise one or more additional performance additives to from an additive package. Additional performance additives can be added to a fuel composition depending on several factors to include the type of internal combustion engine and the type of fuel being used in that engine, the quality of the fuel, and the service conditions under which the engine is being operated. The additional performance additives can include an antioxidant such as a hindered phenol or derivative thereof and/or a diarylamine or derivative thereof, a corrosion inhibitor such as an alkenylsuccinic acid, including PIB succinic acid, and/or a detergent/dispersant additive such as a polyetheramine or nitrogen containing detergent, including but not limited to PIB amine dispersants, Mannich dispersants, quaternary salt dispersants, and succinimide dispersants.

Further additives can include, dyes, bacteriostatic agents and biocides, gum inhibitors, marking agents, and demulsifiers, such as polyalkoxylated alcohols. Other additives can include lubricity agents, such as fatty carboxylic acids, metal deactivators such as aromatic triazoles or derivatives thereof, and valve seat recession additives such as alkali metal sulfosuccinate salts. Additional additives can include, antistatic agents, de-icers, and combustion improvers such as an octane or cetane improver.

Fluidizer

In one embodiment, the additional additives can comprise fluidizers such as mineral oil and/or poly(alpha-olefins) and/or polyethers. In another embodiment, the fluidizer can be a polyetheramine. In another embodiment, the polyetheramine can be a detergent. The polyetheramine can be represented by the formula $R[OCH_2CH(R^1)]nA$, where R is a hydrocarbyl group, $R^1$ is selected from the group consisting of hydrogen, hydrocarbyl groups of 1 to 16 carbon atoms, and mixtures thereof, n is a number from 2 to about 50, and A is selected from the group consisting of $—OCH_2CH_2CH_2NR^2R^2$ and $—NR^3R^3$, where each $R^2$ is independently hydrogen or hydrocarbyl, and each $R^3$ is independently hydrogen, hydrocarbyl or $—[R^4N(R^5)]pR^6$, where $R^4$ is $C_2$-$C_{10}$ alkylene, $R^5$ and $R^6$ are independently hydrogen or hydrocarbyl, and p is a number from 1-7. These polyetheramines can be prepared by initially condensing an alcohol or alkylphenol with an alkylene oxide, mixture of alkylene oxides or with several alkylene oxides in sequential fashion in a 1:2-50 mole ratio of hydric compound to alkylene oxide to form a polyether intermediate. U.S. Pat. No. 5,094,667 provides reaction conditions for preparing a polyether intermediate, the disclosure of which is incorporated herein by reference. In one embodiment, the alcohols can be linear or branched from 1 to 30 carbon atoms, in another embodiment 6 to 20 carbon atoms, in yet another embodiment from 10 to 16 carbon atoms. The alkyl group of the alkylphenols can be 1 to 30 carbon atoms, in another embodiment 10 to 20 carbon atoms. Examples of the alkylene oxides include ethylene oxide, propylene oxide or butylene oxide. The number of alkylene oxide units in the polyether intermediate can be 10-35 or 18-27. The polyether intermediate can be converted to a polyetheramine by amination with ammonia, an amine or a polyamine to form a polyetheramine of the type where A is $—NR^3R^3$. Published Patent Application EP310875 provides reaction conditions for the amination reaction, the disclosure of which is incorporated herein by reference. Alternately, the polyether intermediate can also be converted to a polyetheramine of the type where A is $—OCH_2CH_2CH_2NR^2R^2$ by reaction with acrylonitrile followed by hydrogenation. U.S. Pat. No. 5,094,667 provides reaction conditions for the cyanoethylation and subsequent hydrogenation, the disclosure of which is incorporated herein by reference. Polyetheramines where A is $—OCH_2CH_2CH_2NH_2$ are typically preferred. Commercial examples of polyetheramines are the Techron™ range from Chevron and the Jeffamine™ range from Huntsman.

In another embodiment, the fluidizer can be a polyether, which can be represented by the formula $R^7O[CH_2CH(R^8)O]qH$, where $R^7$ is a hydrocarbyl group, $R^8$ is selected from the group consisting of hydrogen, hydrocarbyl groups of 1 to 16 carbon atoms, and mixtures thereof, and q is a number from 2 to about 50. Reaction conditions for preparation as well as various embodiments of the polyethers are presented above in the polyetheramine description for the polyether intermediate. A commercial example of a polyether is the Lyondell ND™ series. Other suitable polyethers are also available from Dow Chemicals, Huntsman, and Akzo.

In yet another embodiment, the fluidizer can be a hydrocarbyl-terminated poly-(oxyalklene) aminocarbamate as described U.S. Pat. No. 5,503,644.

In yet another embodiment, the fluidizer can be an alkoxylate, wherein the alkoxylate can comprise: (i) a polyether containing two or more ester terminal groups; (ii) a polyether containing one or more ester groups and one or more terminal ether groups; or (iii) a polyether containing one or more ester groups and one or more terminal amino groups wherein a terminal group is defined as a group located within five connecting carbon or oxygen atoms from the end of the polymer. Connecting is defined as the sum of the connecting carbon and oxygen atoms in the polymer or end group.

An alkoxylate can be represented by the formula:

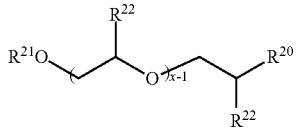

wherein, $R^{21}$ is TC(O)— wherein T is a hydrocarbyl derived from tallow fatty acid; $R^{20}$ is OH, A, WC(O)—, or mixtures thereof, wherein A is $—OCH_2CH_2CH_2NR^{23}R^{23}$ or $—NR^{24}R^{24}$, where each $R^{23}$ is independently hydrogen or hydrocarbyl, and each $R^{24}$ is independently hydrogen, hydrocarbyl or $—[R^{25}N(R^{26})]pR^{26}$ where $R^{25}$ is $C_{2-10}$-alkylene, each $R^{26}$ is independently hydrogen or hydrocarbyl, and p is a number from 1-7, W is a $C_{1-36}$ hydrocarbyl group; $R^{22}$ is H, —$CH_3$, —$CH_2CH_3$ or mixtures thereof; and X is an integer from 1 to 36.

Examples of the alkoxylate can include: $C_{12-15}$ alcohol initiated polypropyleneoxide (22-24) ether amine, Bayer ACTACLEAR ND21-A™ ($C_{12-15}$ alcohol initiated polypropyleneoxide (22-24) ether-ol), tall oil fatty acid initiated polypropyleneoxide (22-24) ester-ol, butanol initiated polypropyleneoxide (23-25) ether-tallow fatty acid ester, glycerol dioleate initiated polypropyleneoxide (23-25) ether-ol, propylene glycol initiated polypropyleneoxide (33-34) ether tallow fatty acid ester, tallow fatty acid initiated polypropyleneoxide (22-24) ester-ol and $C_{12-15}$ alcohol initiated polypropyleneoxide (22-24) ether tallow fatty acid ester.

These alkoxylates can be made from the reaction of a fatty acid such as tall oil fatty acids (TOFA), that is, the mixture of fatty acids predominately oleic and linoleic and contains residual rosin acids or tallow acid that is, the mixture of fatty acids are predominately stearic, palmitic and oleic with an alcohol terminated polyether such as polypropylene glycol in the presence of an acidic catalyst, usually methane sulfonic acid. These alkoxylates can also be made from the reaction of glycerol dioleate and propylene oxide in the presence of catalyst.

Detergent

In one embodiment, the detergent can be a Mannich detergent, sometimes referred to as a Mannich base detergent. A Mannich detergent is a reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well-known polymerization methods and are also commercially available. The olefin monomers include monoolefins, including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69 percent, in a second instance of 50 to 69 percent, and in a third instance of 50 to 95 percent or mixtures thereof. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The hydrocarbyl-substituted phenol can be prepared by alkylating phenol with an olefin or polyolefin described above, such as a polyisobutylene or polypropylene, using well-known alkylation methods.

The aldehyde used to form the Mannich detergent can have 1 to 10 carbon atoms, and is generally formaldehyde or a reactive equivalent thereof such as formalin or paraformaldehyde.

The amine used to form the Mannich detergent can be a monoamine or a polyamine, including alkanolamines having one or more hydroxyl groups, as described in greater detail above. Useful amines include those described above, such as ethanolamine, diethanolamine, methylamine, dimethylamine, ethylenediamine, dimethylaminopropylamine, diethylenetriamine and 2-(2-aminoethyl amino) ethanol. The Mannich detergent can be prepared by reacting a hydrocarbyl-substituted phenol, an aldehyde, and an amine as described in U.S. Pat. No. 5,697,988. In one embodiment, the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The Mannich reaction product can be prepared by well-known methods generally involving reacting the hydrocarbyl substituted hydroxy aromatic compound, an aldehyde and an amine at temperatures between 50 to 200° C. in the presence of a solvent or diluent while removing reaction water as described in U.S. Pat. No. 5,876,468.

In yet another embodiment, the detergent can be a polyisobutylene amine. The amine use to make the polyisobutylene amine can be a polyamine such as ethylenediamine, 2-(2-aminoethylamino)ethanol, or diethylenetriamine. The polyisobutylene amine can be prepared by several known methods generally involving amination of a derivative of a polyolefin to include a chlorinated polyolefin, a hydroformylated polyolefin, and an epoxidized polyolefin. In one embodiment, the polyisobutylene amine is prepared by chlorinating a polyolefin such as a polyisobutylene and then reacting the chlorinated polyolefin with an amine such as a polyamine at elevated temperatures of generally 100 to 150° C. as described in U.S. Pat. No. 5,407,453. To improve processing, a solvent can be employed, an excess of the amine can be used to minimize cross-linking, and an inorganic base such as sodium carbonate can be used to aid in removal of hydrogen chloride generated by the reaction.

Yet another type of suitable detergent is a glyoxylate. A glyoxylate detergent is a fuel soluble ashless detergent which, in a first embodiment, is the reaction product of an amine having at least one basic nitrogen, i.e. one >N—H, and a hydrocarbyl substituted acylating agent resulting from the reaction, of a long chain hydrocarbon containing an olefinic bond with at least one carboxylic reactant selected from the group consisting of compounds of the formula (VII)

$$(R^1C(O)(R^2)_nC(O))R^3 \quad \text{(VII)}$$

and compounds of the formula (VIII)

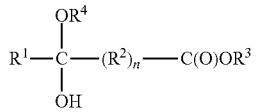

(VIII)

wherein each of $R^1$, $R^3$ and $R^4$ is independently H or a hydrocarbyl group, $R^2$ is a divalent hydrocarbylene group having 1 to 3 carbons and n is 0 or 1.

Examples of carboxylic reactants are glyoxylic acid, glyoxylic acid methyl ester methyl hemiacetal, and other omega-oxoalkanoic acids, keto alkanoic acids such as pyruvic acid, levulinic acid, ketovaleric acids, ketobutyric acids and numerous others. Person of ordinary skill in the art will readily recognize the appropriate compound of formula (VII) to employ as a reactant to generate a given intermediate.

The hydrocarbyl substituted acylating agent can be the reaction of a long chain hydrocarbon containing an olefin and the above described carboxylic reactant of formula (VII) and (VIII), further carried out in the presence of at least one aldehyde or ketone. Typically, the aldehyde or ketone contains from 1 to about 12 carbon atoms. Suitable aldehydes include formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful, although monoaldehydes are generally preferred. Suitable ketones include acetone, butanone, methyl ethyl ketone, and other ketones. Typically, one of the hydrocarbyl groups of the ketone is methyl. Mixtures of two or more aldehydes and/or ketones are also useful. Compounds and the processes for making these compounds are disclosed in U.S. Pat. Nos. 5,696,060; 5,696,067; 5,739,356; 5,777,142; 5,856,524; 5,786,490; 6,020,500; 6,114,547; 5,840,920 and are incorporated herein by reference.

In another embodiment, the glyoxylate detergent is the reaction product of an amine having at least one basic nitrogen, i.e. one >N—H, and a hydrocarbyl substituted acylating agent resulting from the condensation product of a hydroxyaromatic compound and at least one carboxylic reactant selected from the group consisting of the above described compounds of the formula (VII) and compounds of the formula (VIII). Examples of carboxylic reactants are glyoxylic acid, glyoxylic acid methyl ester methyl hemiacetal, and other such materials as listed above.

The hydroxyaromatic compounds typically contain directly at least one hydrocarbyl group R bonded to at least one aromatic group. The hydrocarbyl group R may contain up to about 750 carbon atoms or 4 to 750 carbon atoms, or 4 to 400 carbon atoms or 4 to 100 carbon atoms. In one embodiment, at least one R is derived from polybutene. In another embodiment, R is derived from polypropylene.

In another embodiment, the reaction of the hydroxyaromatic compound and the above described carboxylic acid reactant of formula (VII) or (VIII) can be carried out in the presence of at least one aldehyde or ketone. The aldehyde or ketone reactant employed in this embodiment is a carbonyl compound other than a carboxy-substituted carbonyl compound. Suitable aldehydes include monoaldehydes such as formaldehyde, acetaldehyde, propionaldehyde, butyraldehyde, isobutyraldehyde, pentanal, hexanal, heptaldehyde, octanal, benzaldehyde, and higher aldehydes. Other aldehydes, such as dialdehydes, especially glyoxal, are useful. Suitable ketones include acetone, butanone, methyl ethyl ketone, and other ketones. Typically, one of the hydrocarbyl groups of the ketone is methyl. Mixtures of two or more aldehydes and/or ketones are also useful. Compounds and the processes for making these compounds are disclosed in U.S. Pat. Nos. 3,954,808; 5,336,278; 5,620,949 and 5,458,793 and are incorporated herein by reference.

The detergent additive can be present in a mixture of various detergents referenced above. In one embodiment, the detergent additive can be present in the additive composition at about 3 to about 60% by weight, or from about 3 to about 50% by weight, or from about 3 to about 20% weight by weight, or from about 10 to about 20% by weight.

The detergent additive can be present in a fuel composition in one embodiment on a weight basis at 1 to 10,000 ppm (parts per million), and in other embodiments can be present at 10 to 5,000 ppm, at 10 to 3000 ppm, at 10 to 1000, or at 10 to 600 or at 10 to 300 ppm.

The additional performance additives can each be added directly to the additive composition and/or fuel compositions described herein, but they are generally added together in an additive concentrate to a fuel having the additive composition described above (friction modifier ("FM") package). Exemplary FM packages include the compositions in Table 1 below. The weight percent (wt %) listed in the tables are based on a total weight of the additive composition (package) and individual additives can include solvents.

TABLE 1

| | FM Package Embodiments (wt %) | | |
|---|---|---|---|
| Additive | A | B | C |
| Hydroxycarboxylic Acid (a) | 5 to 30 | 10 to 20 | 12 to 17 |
| HSSA Compound (b) | 15 to 50 | 20 to 40 | 30 to 40 |
| Organic Solvent | Balance | Balance | Balance |

Alternatively, the additional performance additives can be in an additive concentrate comprise an FM package that is formulated for a specific fuel type. These types of additive concentrate, can include, but are not limited to, gasoline additive and friction modifier ("GA FM") packages. Exemplary GA FM packages are shown in Table 2 below. The weight percent (wt %) listed in the tables are based on a total weight of the additive composition (package) and individual additives can include solvents.

TABLE 2

| | GA FM Package Embodiments (wt %) | | |
|---|---|---|---|
| Additive | D | E | F |
| Hydroxycarboxylic Acid (a) | 0.1 to 20 | 0.5 to 15 | 1 to 10 |
| HSSA Compound (b) | 0.1 to 20 | 0.5 to 15 | 1 to 10 |
| Organic Solvent (xylene) | 0 to 70 | 0 to 50 | 0 to 40 |
| Organic Solvent (2-ethylhexanol) | 0 to 40 | 0 to 30 | 0 to 20 |
| Organic Solvent (HAN) | 0 to 40 | 0 to 35 | 0 to 30 |
| Fluidizer (polyether) | 0 to 40 | 0 to 30 | 0 to 20 |
| Detergent (polyetheramine) | 0 to 70 | 0 to 50 | 0 to 30 |
| Detergent (Mannich) | 0 to 70 | 20 to 60 | 30 to 50 |
| Detergent (PIB-amine) | 0 to 70 | 20 to 60 | 30 to 50 |
| Demulsifier (polyalkoxylated alcohol) | 0 to 5 | 0 to 3 | 0 to 1 |
| Corrosion Inhibitor (PIB-succinic acid) | 0 to 3 | 0 to 2 | 0 to 1 |
| Total (total of the above additives)* | 100 | 100 | 100 |

*Persons of ordinary skill in the art will understand that the amount of each additive for a GA FM package will be selected such that the total will equal 100% even if the ranges listed in the table may not equal 100%.

INDUSTRIAL APPLICATION

In one embodiment the fuel compositions described above are useful for liquid fuel engines and/or for spark ignited engines and can include engines for hybrid vehicles and stationary engines. The type of engine is not overly limited and includes, but is not limited to, V, inline, opposed, and rotary engines. The engines may be naturally aspirated, boosted, E-boosted, supercharged, or turbocharged engines. The engine may be a carbureted or fuel injected gasoline engine. As such, the engine may have a carburetor or injectors (including piezo injectors).

In one embodiment, the engine may be a gasoline direct injection ("GDI") engine (spray or wall guided, or combinations thereof), a port fuel injection ("PFI") engine, a homogeneous charge compression ignition ("HCCI") engine, stoichiometric burn or lean burn engines, spark controlled compression ignition ("SPCCI") engine, variable compression, Miller cycle or Atkinson cycle engines, or a combination thereof, such as an engine that contains both GDI and PFI injectors in the same engine. Suitable GDI/PFI engines includes 2-stroke or 4-stroke engines fueled with gasoline, a mixed gasoline/alcohol or any of the fuel compositions described in the sections above. The additive composition can reduce wear in, and/or improve fuel economy of, an engine, such as a GDI/PFI engine. In yet other embodiments, the fuel compositions may be prepared using an on-board dosing system for either a GDI engine, a PFI engine, or a combination thereof.

In yet other embodiments any of the above engines may be equipped with a catalyst or device for treating exhaust emissions, such as reducing NOx. In other embodiments the engine may be a flexible-fuel engine able to operate on more than one fuel type, typically, gasoline and ethanol or gasoline and methanol. In yet other embodiments, any of the above engine types may be in a hybrid vehicle that also includes an electric motor.

In other embodiments the additive compositions can improve the solubility of a fuel comprising an oxygenate, thereby providing improved low temperature storage stability and so improved handling properties for the friction modifier itself and additive compositions and/or concentrates containing the friction modifier. In other embodiments, the GA FM packages have less organic solvents than other FM packages.

It is known that some of the materials described above may interact in the final formulation, so that the components of the final formulation may be different from those that are initially added. The products formed thereby, including the products formed upon employing the compositions disclosed herein may not be susceptible of easy description. Nevertheless, all such modifications and reaction products are included within the scope of the disclosed technology, including compositions prepared by admixing the components described above.

The disclosed technology may be further illustrated by the following examples.

EXAMPLES

Several GA FM packages are prepared as listed in Table 3. The GA FM packages are mixed and heated to 80° C. and then held at temperature for 30 minutes. The prepared samples are then allowed to cool to room temperature.

For the stability tests, each sample is then added to five different test tubes for storage at different temperatures. First, an "initial" visual assessment of compatibility is made for one of the test tubes upon cooling to room temperature and the assessment is recorded. The remaining four samples are maintained at 43° C., 0° C., and −18° C. respectively. The stability of all five samples is visually assessed at seven and at fourteen days.

Storage Stability Rating Table

| Code | Description | Definition |
|---|---|---|
| C | Clear | The filament of the light bulb can be seen through the sample with no distortion of the filament. No signs of instability. |
| Z1 | Slightly Hazy | Slight distortion of light filament. |
| Z2 | Hazy | Light is able to pass through the sample, the filament may be visible (glow stick). |
| S1 | Slight trace | Sediment only becomes visible after inversion i.e. ghosting effect. |
| S2 | Trace sediment | This is any amount of sediment that is visible on the tube bottom. The tube may need to be inverted due to clarity/color/viscosity of the sample. |
| S4 | Heavy sediment | Sediment over 1/16 inch (2 mm) |
| N1 | Fine Suspension | Fine particles can be seen throughout the sample or when tilted/inverted. |
| N2 | Suspension | More obvious larger particles can be seen throughout the sample. |
| X | Crystallized | Crystals of any size are observed suspended in the fluid or on the tube bottom. They are jaggy and have an ice-like appearance. |
| G1 | Light gel | A portion of the sample has gel or jelly like appearance and texture. The gel may be dispersed throughout the sample as fine globules, present at the bottom of tube or cling to the walls. |
| G2 | Gel | Clumpy, jelly like appearance and texture, sometimes dry and crackly when inverted. (Tends to stretch or break off after inversion). |
| DM | Solid | More than half of the sample does not flow within 30 seconds of being inverted. |
| F | Flocculent | Contains cloud like or cotton ball (wool) particles which are randomly suspended in the sample. |

The stability results of the GA FM packages are shown in Table 4.

TABLE 3

| ADDITIVE | Co1 | Ex1 | Ex2 | Co2 | Ex3 | Ex4 | Co3 | Ex5 | Ex6 |
|---|---|---|---|---|---|---|---|---|---|
| Friction Modifier (polyoxyethylene tallow amine) | 9.82 | | | | | | | | |
| Friction Modifier (polyol ester oleate) | 9.82 | | | | | | | | |
| hydroxycarboxylic Acid (a) (Ricinoleic acid) | — | — | — | — | — | — | 19.65 | — | — |
| hydroxycarboxylic Acid (a) (12-hydroxystearic acid) | — | 5.89 | 5.89 | 19.65 | 4.85 | 4.85 | — | 7.31 | 7.31 |
| HSSA Compound (b) (Formula I) | — | 8.66 | — | — | 7.13 | — | — | 10.75 | — |
| HSSA Compound (b) (Formula II) | — | — | 13.75 | — | — | 11.33 | — | — | 17.06 |
| Organic Solvent (xylene) | 32.50 | 37.59 | 32.50 | 32.50 | 4.19 | — | 32.50 | 6.31 | — |
| Organic Solvent (2-ethylhexanol) | — | 8.14 | 8.14 | 8.14 | 24.67 | 24.67 | 8.14 | 15.70 | 15.70 |
| Organic Solvent (HAN) | — | — | — | — | 24.69 | 24.69 | — | 23.56 | 23.56 |
| Remaining GA FM Additives | 47.86 | 39.72 | 39.72 | 39.71 | 34.47 | 34.48 | 39.71 | 36.37 | 36.37 |

TABLE 4

| STABILITY | Co1 | Ex1 | Ex2 | Co2 | Ex3 | Ex4 | Co3 | Ex5 | Ex6 |
|---|---|---|---|---|---|---|---|---|---|
| 7 days at 43° C. | C | C | C/S1 | — | C/S1 | C/S1 | — | C | C/S1 |
| 7 days at room temperature | C | C | C | S1 | C/S1 | C/S1 | S1 | C/S1 | C |
| 7 days at 0° C. | C | C | C | C | C | C | S1 | C | C |
| 7 days at −18° C. | C/S2/F | C | C | Z1 | C | C | X/S4 | C | C |
| 28 days at 43° C. | Z1/S2 | C | C/S1 | — | C/S1 | C/S1 | — | C | C/S1 |
| 28 days at room temperature | C | C/S1 | C/S1 | S1 | C/S1 | C/S1 | S1 | C/S1 | C/S1 |
| 28 days at 0° C. | C/S2 | C/S1 | C | C | C/S1 | C/S1 | S1 | C | C |
| 28 days at −18° C. | C/S2/F | C | C | S2 | C | C | X/S4 | Z1 | C |

For the wear test, a sample is tested using a high-frequency reciprocating rig (HFRR) using ASTM Standard D6079. Finished fuels are prepared using the GA FM packages of Table 3 at various treat rates. A 15 mL gasoline sample with the GA FM package is then placed in the test reservoir of the rig and adjusted to 25° C. A vibrator arm holding a non-rotating steel ball and loaded with a 200 g mass is lowered until it contacts a test disk completely submerged in the fuel. When the temperature has stabilized, the ball is caused to rub against the disk with a 1 mm stroke at a frequency of 50 Hz for 75 min. The ball is removed from the vibrator arm and cleaned. The dimensions of the major and minor axes of the wear scar are measured under 100× magnification and recorded. Percent Film Thickness and Average Friction Coefficient data are also obtained from the rig computer software and recorded. The HFRR results of the disclosed technology are shown in Table 5 below.

TABLE 5

| HFRR Results | Base Fuel[1] | Ex1 | Ex2 | Ex3 | Ex4 | Ex5 | Ex6 |
|---|---|---|---|---|---|---|---|
| Dose actives (ppm) | — | 56 | 76 | 97 | 131 | 111 | 149 |
| Ave film thickness (%) | 53.8 | 35 | 32 | 42 | 48 | 43 | 69 |
| Coefficient of friction | 0.65 | 0.32 | 0.32 | 0.28 | 0.27 | 0.28 | 0.26 |
| Wear Scar (μm) | 849 | 650 | 648 | 651 | 561 | 606 | 558 |
| Dose actives (ppm) | — | 27 | 37 | 49 | 66 | 55 | 74 |
| Ave film thickness (%) | 53.8 | 19 | 21 | 25 | 29 | 24 | 36 |
| Coefficient of friction | 0.65 | 0.42 | 0.41 | 0.35 | 0.33 | 0.34 | 0.31 |
| Wear Scar (μm) | 849 | 761 | 738 | 661 | 665 | 715 | 647 |

[1]Average of 5 data points

Examples—Vehicle Test Results—Fuel Economy

An exemplary FM package tested for fuel economy using the Federal Test Procedure ("FTP-75") and the Highway Fuel Economy Test ("HwFET") on a chassis dynamometer. For the tests, two gasoline fuel samples are prepared. The first sample, Co 5, is an unadditized base gasoline fuel, Haltermann EEE. For the second sample, Ex 7, 240 ppm of an FM package comprising 12-hydroxystearic acid:HSSA Formula II:HAN at 15:35:50 is added to the base fuel.

The engine used for the tests is a 3.6 L, six cylinder port fuel injection engine of a 2012 Chevrolet Malibu. Mileage accumulations were conducted at the SwRI Light Duty Vehicle Technology (LDVT) test laboratory and Mileage Accumulation Dynamometer (MAD) facility using the Direct Electronic Vehicle Control or DEVCon™ system. (Test Reference: Blanks, M. and Forster, N., "Technical Approach to Increasing Fuel Economy Test Precision with Light Duty Vehicles on a Chassis Dynamometer", SAE Technical Paper 2016-01-0907, 2016, doi: 10.4271/2016-01-0907.)

Before each test, the engine was filled with fresh oil and run for 60 miles. The oil was then drained from the engine and the process was repeated two more times.

Before fuel economy measurements, fresh oil was added and conditioned for 300 miles. Conditioning is done with the oil to get the oil fully sheared to a stable state.

The FTP-75 consists of a cold-start transient phase (Phase 1), followed immediately by a stabilized phase (Phase 2). Following the stabilized phase, the vehicle is allowed to soak for 10 minutes with the engine turned off before proceeding with a hot-start transient phase (Phase 3) to complete the test. The HwFET (Phase 4) is a hot running cycle that commences immediately following the end of the FTP-75.

The combined fuel economy is then calculated using the official weighing factors and formulae as specified in 40 CFR Parts 86 and 600. Each fuel was tested in triplicate and fuel economy results were averaged. The Fuel Economy Index ("FEI") is then calculated using the following formula:

$$FEI\ (\%) = \frac{\text{Fuel } Economy_{Test\ Fuel} - \text{Fuel } Economy_{Baseline\ Fuel}}{\text{Fuel } Economy_{Baseline\ Fuel}} \times 100$$

The FEI results of the exemplary FM package Ex 7 is shown in FIG. 1. The results show compositions comprising a hydroxycarboxylic acid and a compound derived from a hydrocarbyl-substituted succinic acid or anhydride ("HSSA compound") can improve an engine's fuel economy.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined.

Similarly, the ranges and amounts for each element disclosed herein can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

While certain representative embodiments and details have been shown for the purpose of illustrating the subject technology, it will be apparent to those skilled in this art that various changes and modifications can be made therein without departing from the scope disclosed herein. In this regard, the scope of the following claims should generally be construed to cover all such obvious changes and modifications.

What is claimed is:

1. A fuel composition comprising gasoline, oxygenate, or mixtures thereof and an additive composition comprising:

(a) a hydroxycarboxylic acid; and (b) a compound derived from a hydrocarbyl-substituted succinic acid or anhydride ("HSSA compound"), wherein the ratio of (a) to (b) in said additive composition ranges from 1:9 to 9:1; and wherein said additive composition is present in an amount of at least 0.1 ppm to 1000 ppm based on a total weight of said fuel composition.

2. The additive composition of claim 1, wherein said additive composition further comprises (c) an organic solvent.

3. The additive composition of claim 2, wherein said organic solvent comprises at least one of 2-ethylhexanol, naphtha, dimethylbenzene, or mixtures thereof.

4. The additive composition of claim 1, wherein at least a portion of the HSSA compound has the formula (I):

(I)

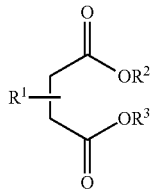

wherein $R^1$ is a $C_1$ to $C_{50}$ linear or branched hydrocarbyl group; at least one of $R^2$ and $R^3$ is present and is a hydrocarbyl amine group or a $C_1$ to $C_5$ hydrocarbyl group, and the other of $R^2$ or $R^3$, if present, is a hydrogen or a $C_1$ to $C_5$ hydrocarbyl group.

5. The additive composition of claim 1, wherein at least a portion of the HSSA compound has the formula (II):

(II)

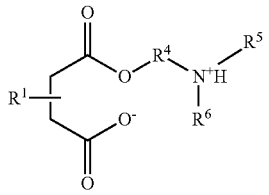

wherein $R^1$ is a $C_1$ to $C_{50}$ linear or branched hydrocarbyl group; $R^4$ is a $C_1$ to $C_5$ linear or branched hydrocarbyl group; and $R^5$ and $R^6$ are independently hydrogen or a $C_1$ to $C_4$ linear or branched hydrocarbyl group.

6. The additive composition of claim 1, wherein at least a portion of the HSSA compound has the formula (III):

(III)

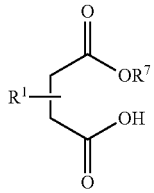

wherein $R^1$ is a $C_1$ to $C_{50}$ linear or branched hydrocarbyl group; and $R^7$ is a $C_1$ to $C_5$ hydrocarbyl group.

7. The additive composition of claim 1, wherein at least a portion of said hydroxycarboxylic acid has the formula (IV):

(IV)

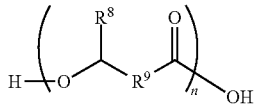

wherein $R^8$ is hydrogen or a $C_1$ to $C_{20}$ hydrocarbyl group; $R^9$ is a $C_1$ to $C_{20}$ hydrocarbyl group; and n is a number from 1 to 8.

8. The additive composition of claim 1, wherein said hydroxycarboxylic acid comprises at least one polyhydroxycarboxylic acid.

9. The additive composition of claim 1, wherein said hydroxycarboxylic acid comprises at least one of 12-hydroxystearic acid, ricinoleic acid, or mixtures thereof.

10. The fuel composition of claim 1, wherein said oxygenate is ethanol.

11. A method of reducing wear in and/or increasing the Fuel Economy Index ("FEI") of an engine, said method comprising operating said engine on the fuel composition of claim 1.

12. The method of claim 11, wherein the FEI is increased by at least 0.8%, or at least 1%.

13. The method of claim 11, wherein said engine is a gasoline direct injection ("GDI") engine, a port fuel injection ("PFI") engine, or a combination thereof.

* * * * *